US010265979B2

(12) United States Patent
Wei et al.

(10) Patent No.: US 10,265,979 B2
(45) Date of Patent: Apr. 23, 2019

(54) THERMOSENSITIVE PRINTING DEVICE

(71) Applicant: Primax Electronics Ltd., Taipei (TW)

(72) Inventors: Yi-Lun Wei, Taipei (TW); Chen-Yu Lee, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 9 days.

(21) Appl. No.: 15/790,855

(22) Filed: Oct. 23, 2017

(65) Prior Publication Data

US 2018/0333973 A1 Nov. 22, 2018

(30) Foreign Application Priority Data

May 19, 2017 (TW) ..... 106116692 A

(51) Int. Cl.
*B41J 25/312* (2006.01)
*B41J 2/32* (2006.01)

(52) U.S. Cl.
CPC ..... *B41J 25/312* (2013.01); *B41J 2/32* (2013.01)

(58) Field of Classification Search
CPC ..... B41J 25/312; B41J 2/32
See application file for complete search history.

(56) References Cited

U.S. PATENT DOCUMENTS 9,132,675 B1 * 9/2015 Yu ..... B41J 2/32
2002/0080223 A1 * 6/2002 Connor ..... B41J 2/32 347/198
2013/0113858 A1 * 5/2013 Gotschewski ..... B41J 29/13 347/17

FOREIGN PATENT DOCUMENTS

JP 05169689 A * 7/1993

* cited by examiner

*Primary Examiner* — Kristal Feggins
*Assistant Examiner* — Kendrick X Liu
(74) *Attorney, Agent, or Firm* — Kirton McConkie; Evan R. Witt

(57) ABSTRACT

A thermosensitive printing device includes a print roller, a printhead module, a printhead pressure adjusting mechanism and a casing. The printhead pressure adjusting mechanism is supported by the casing. When a print medium is transferred through a region between the printhead module and the print roller, the print medium is printed by the printhead module. The printhead pressure adjusting mechanism is located over the printhead module and contacted with the printhead At least a portion of the printhead pressure adjusting mechanism is penetrated through the casing groove and movable within the casing groove according to a width of the print medium. The printhead pressure adjusting mechanism includes an adjusting knob and an identification pattern. When an adjusting knob is rotated, a pressure of the printhead pressure adjusting mechanism applied to the printhead module is adjusted and the pressure is recognized according to the identification pattern.

10 Claims, 9 Drawing Sheets

THERMOSENSITIVE PRINTING DEVICE

FIELD OF THE INVENTION

The present invention relates to an output device, and more particularly to a thermosensitive printing device.

BACKGROUND OF THE INVENTION

Nowadays, thermosensitive printing devices are widely used in catering industries, retail industries, equipment management fields, transportation fields, and so on. The thermosensitive printing devices can be used to print transaction certificates, equipment labels and transport numbers. As the applications of the thermosensitive printing devices are gradually expanded, the types of the print media to be used are diversified. Generally, the pressure of the printhead module of the thermosensitive printing device is correlated with the thickness, the width and the sensed temperature of the print medium. In other words, the pressure of the printhead module for a different print medium is different. Since the pressure of the printhead module has a high influence on the printing quality, the conventional thermosensitive printing device is usually equipped with a pressure adjusting mechanism for adjusting the pressure on the printhead module. The pressure adjusting mechanism has a spring structure. By using the pressure adjusting mechanism, the pressure value is maintained in the optimized pressure range. Consequently, the thermosensitive printing device has the better printing quality.

FIG. 1 is a schematic cross-sectional view illustrating the structure of a conventional printhead pressure adjusting mechanism. The conventional printhead pressure adjusting mechanism is disclosed in Chinese Patent Publication No. CN201120569726.9. As shown in FIG. 1, the printhead pressure adjusting mechanism 1 comprises a supporting shaft 16 and two pressure adjusting assemblies 17. The two pressure adjusting assemblies 17 are separated from each other and fixed on the supporting shaft 16. Each pressure adjusting assembly 17 comprises a bracket 11 and a movable post 14. The bracket 11 is fixedly connected with the supporting shaft 16. The movable post 14 comprises a thread structure and an adjusting nut 13 corresponding to the thread structure. A first end of the movable post 14 has the thread structure. Moreover, the first end of the movable post 14 is penetrated through an opening (not shown) of the supporting shaft 16. A second end of the movable post 14 has a movable block 15. The movable block 15 is contacted with a printhead module (not shown). Moreover, a spring 12 is sheathed around the movable post 14 and arranged between the supporting shaft 16 and the adjusting nut 13. A print medium (not shown) is transferred through the region between the printhead module and a print roller (not shown). Moreover, the print medium is pressed by the printhead module.

As the adjusting nut 13 of the printhead pressure adjusting mechanism 1 is rotated, the deformation amount of the spring 12 is changed. Consequently, the pressure of the movable block 15 applied to the printhead module is adjusted.

However, the printhead pressure adjusting mechanism 1 still has the following drawbacks. Firstly, in case that a side of the print medium is aligned with a side of the width of the printhead module (i.e., in a side-by-side arrangement) and the width of the print medium is small (i.e., a narrow print medium), there is a gap between the print roll and the region without the print medium. Under this circumstance, the printhead module is inclined along the width of the print medium. For assuring the printing quality and correcting the inclined printhead module, it is necessary to increase the printhead pressure on the print medium. Although the increase of the printhead pressure results in reliable contact between the printhead module and the print medium, the possibility of causing damage of the printhead module increased. Moreover, the force of the printhead module is also not uniformly exerted on the printhead medium.

Secondly, the rotation of the adjusting nut 13 changes the deformation amount of the spring 12, and thus the pressure of the movable block 15 applied to the printhead module is correspondingly changed. Generally, the adjusting nut 13 is located at a lateral side of the pressure adjusting assembly 17. Since the printhead pressure adjusting mechanism 1 is covered by a casing (not shown) of a thermosensitive printing device (not shown), it is not convenient for the user to rotate the adjusting nut 13. For example, the casing has to be detached from the thermosensitive printing device when the process of rotating the adjusting nut 13 is performed.

Thirdly, during the process of using the thermosensitive printing device, it is not easy for the user to recognize the status of the adjusting nut 13 and the rotation amount of the adjusting nut 13. If the type of the print medium is changed, the user cannot quickly rotate the adjusting nut 13 to a proper position to have the printhead module apply a suitable pressure on the print medium.

In other words, the conventional thermosensitive printing device needs to be further improved.

SUMMARY OF THE INVENTION

The present invention relates to a thermosensitive printing device. The thermosensitive printing device includes a printhead pressure adjusting mechanism. The printhead pressure adjusting mechanism is movable according to the width of a print medium. An adjusting knob of the printhead pressure adjusting mechanism is exposed to a top side of a casing for facilitating the user to adjust the pressure on the printhead module and move the printhead pressure adjusting mechanism. Moreover, the adjusting knob of the second printhead pressure adjusting mechanism has an identification pattern for facilitating the user to recognize the rotation amount of the identification pattern on the adjusting knob. The user can rotate the adjusting knob to a proper position quickly according to the rotation amount of the identification pattern. Consequently, the printhead module applies a suitable pressure on the print medium.

In accordance with an aspect of the present invention, there is provided a thermosensitive printing device. The thermosensitive printing device includes a print roller, a printhead module, a printhead pressure adjusting mechanism and a casing. The printhead module is located over the print roller. When a print medium is transferred through a region between the printhead module and the print roller, the print medium is printed by the printhead module. The printhead pressure adjusting mechanism is located over the printhead module and contacted with the printhead module. The printhead pressure adjusting mechanism includes an adjusting knob and an identification pattern. When the adjusting knob is rotated, a pressure of the printhead pressure adjusting mechanism applied to the printhead module is adjusted and the pressure of the printhead pressure adjusting mechanism applied to the printhead module is recognized according to the identification pattern. The casing includes a casing groove. The printhead pressure adjusting mechanism is supported by the casing. At least a portion of the printhead pressure adjusting mechanism is penetrated through the casing groove and movable within the casing groove according to a width of the print medium.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
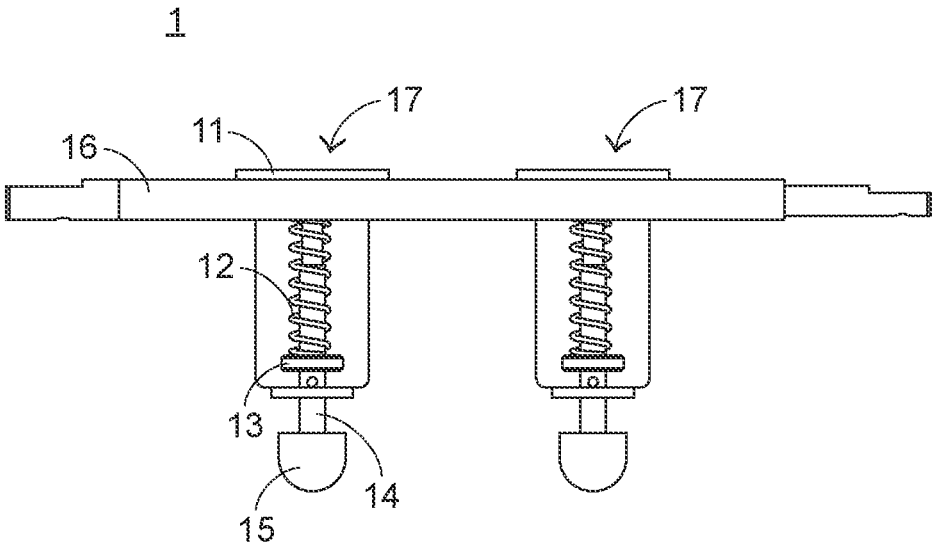
FIG.1 PRIOR ART
FIG. 1 is a schematic cross-sectional view illustrating the structure of a conventional printhead pressure adjusting mechanism.
Figure 2:
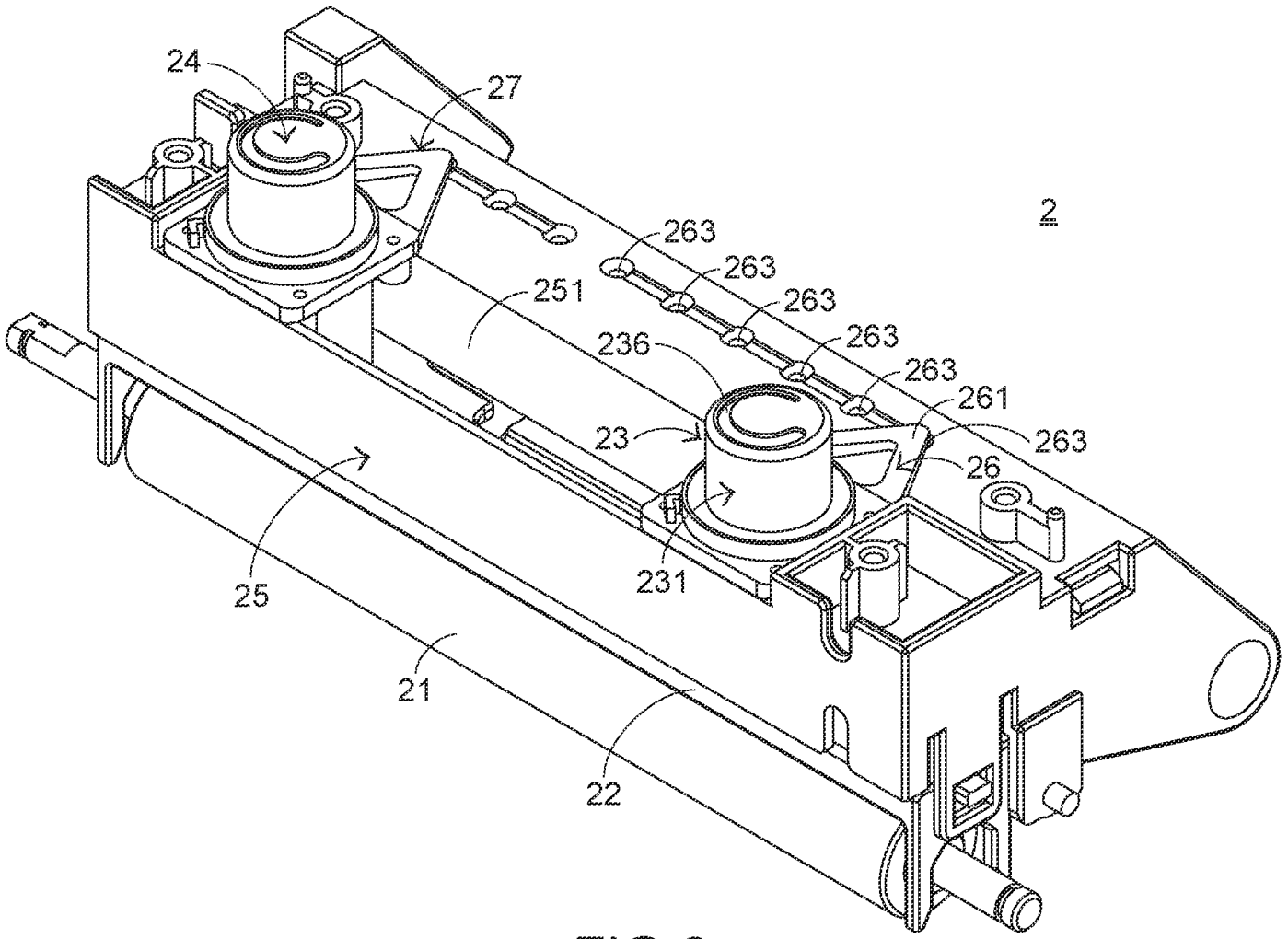
FIG. 2 is a schematic perspective view illustrating a portion of a thermosensitive printing device according to a first embodiment of the present invention.
Figure 3:
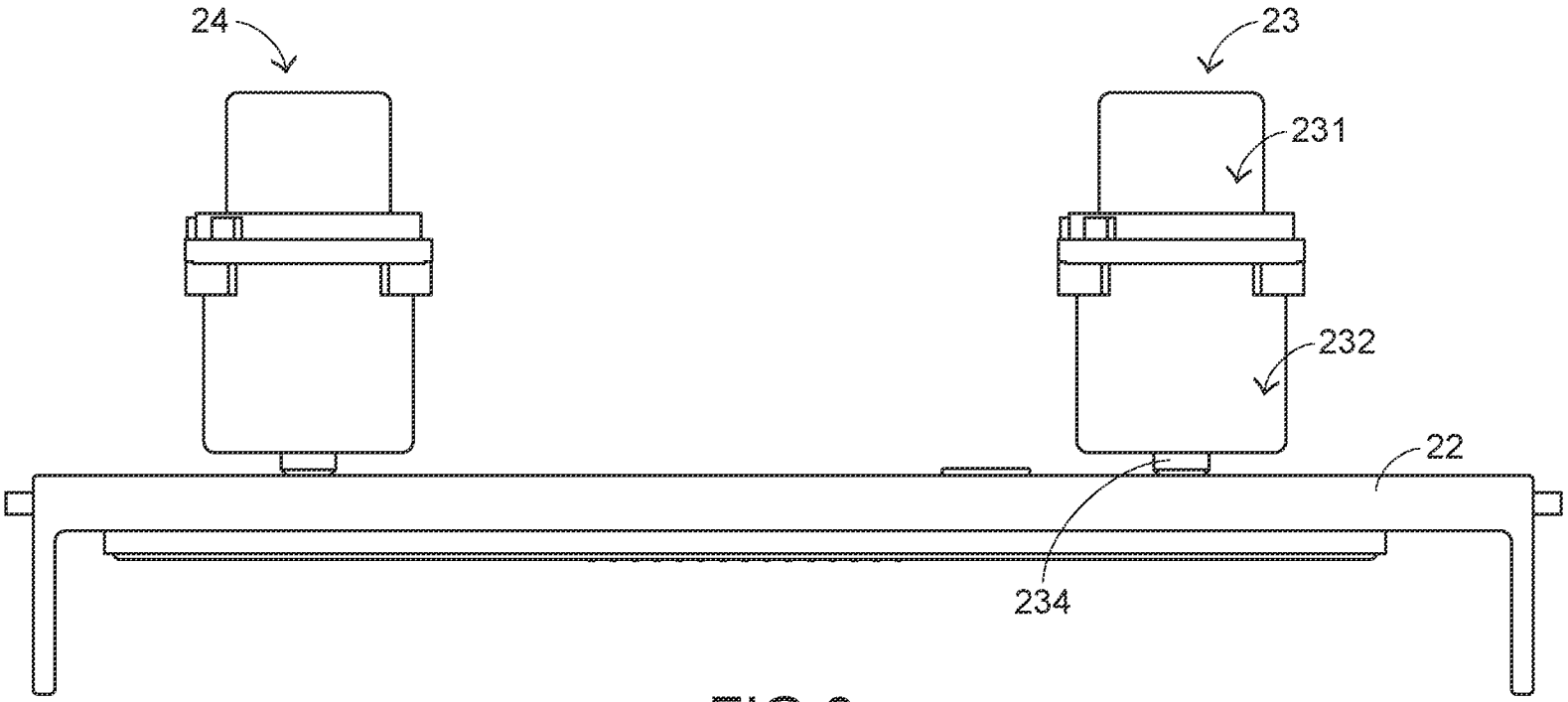
FIG. 3 is a schematic side view illustrating a first printhead pressure adjusting mechanism, a second printhead pressure adjusting mechanism and a printhead module of the thermosensitive printing device as shown in FIG. 2.

Please refer to FIGS. 2 and 3. FIG. 2 is a schematic perspective view illustrating a portion of a thermosensitive printing device according to a first embodiment of the present invention. FIG. 3 is a schematic side view illustrating a first printhead pressure adjusting mechanism, a second printhead pressure adjusting mechanism and a printhead module of the thermosensitive printing device as shown in FIG. 2. The thermosensitive printing device 2 comprises a print roller 21, a printhead module 22, a first printhead pressure adjusting mechanism 23, a second printhead pressure adjusting mechanism 24 and a casing 25. The printhead module 22 is located over the print roller 21. A print medium (not shown) is transferred through a region between the printhead module 22 and the print roller 21. The printhead module 22 is used for printing the print medium. The heating technology and the printing principle of the printhead module 22 are well known to those skilled in the art, and are not redundantly described herein.

The first printhead pressure adjusting mechanism 23 and the second printhead pressure adjusting mechanism 24 are located over the printhead module 22 and separated from each other. Moreover, the first printhead pressure adjusting mechanism 23 and the second printhead pressure adjusting mechanism 24 are contacted with the printhead module 22. When the first printhead pressure adjusting mechanism 23 and the second printhead pressure adjusting mechanism 24 are adjusted by the user, the pressure of the first printhead pressure adjusting mechanism 23 applied to the printhead module 22 and the pressure of the second printhead pressure adjusting mechanism 24 applied to the printhead module 22 are respectively controlled.

The first printhead pressure adjusting mechanism 23 and the second printhead pressure adjusting mechanism 24 are supported by the casing 25. A casing groove 251 is formed in a top surface of the casing 25. A portion of the first printhead pressure adjusting mechanism 23 and a portion of the second printhead pressure adjusting mechanism 24 are penetrated upwardly through the casing groove 251. Moreover, the first printhead pressure adjusting mechanism 23 and the second printhead pressure adjusting mechanism 24 are movable within the casing groove 251 according to the width of the print medium. For example, in case that at least one of the first printhead pressure adjusting mechanism 23 and the second printhead pressure adjusting mechanism 24 is moved within the casing groove 251, the first printhead pressure adjusting mechanism 23 and the second printhead pressure adjusting mechanism 24 are aligned with two lateral sides of the print medium, respectively.

Figure 4:
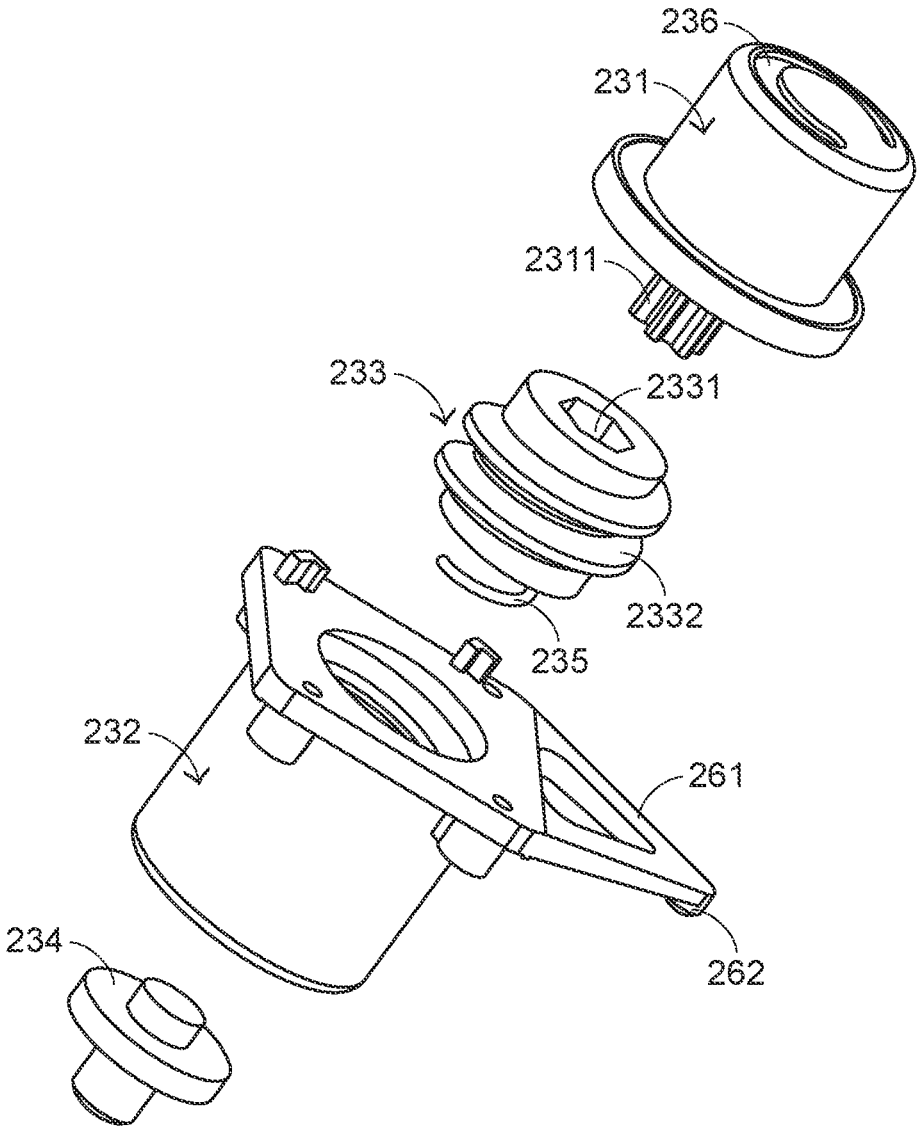
FIG. 4 is a schematic exploded view illustrating the first printhead pressure adjusting mechanism of the thermosensitive printing device as shown in FIG. 2.

FIG. 4 is a schematic exploded view illustrating the first printhead pressure adjusting mechanism of the thermosensitive printing device as shown in FIG. 2. The first printhead pressure adjusting mechanism 23 comprises an adjusting knob 231, an outer shell 232, an active pressure element 233, a passive pressure element 234, an elastic element 235 and an identification pattern 236. The outer shell 232 is located under the adjusting knob 231. Moreover, the active pressure element 233, the passive pressure element 234 and the elastic element 235 are accommodated within the outer shell 232. The elastic element 235 is arranged between the active pressure element 233 and the passive pressure element 234. A first end of the passive pressure element 234 is contacted with the elastic element 235. A second end of the passive pressure element 234 is penetrated downwardly through the outer shell 232 and contacted with the printhead module 22. While the adjusting knob 231 is rotated, the active pressure element 233 is synchronously rotated and moved upwardly or downwardly. Consequently, the deformation amount of the elastic element 235 is changed. As the deformation amount of the elastic element 235 is changed, the elastic force of the elastic element 235 exerted on the passive pressure element 234 is correspondingly changed. Consequently, the pressure of the passive pressure element 234 applied to the printhead module 22 is changed. The identification pattern 236 is formed on a top surface of the adjusting knob 231. The pressure of the first printhead pressure adjusting mechanism 23 applied to the printhead module 22 is recognized by the user according to the identification pattern 236.

Figure 5:
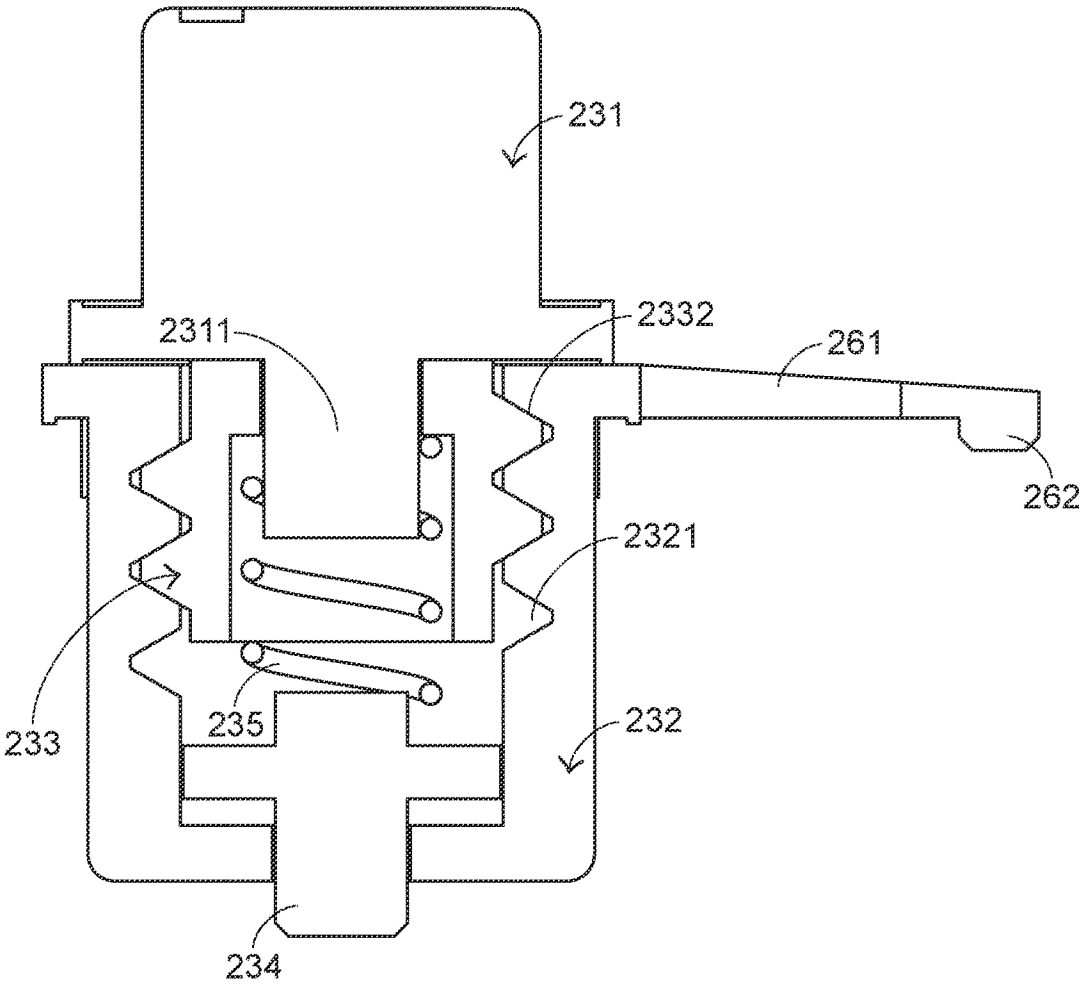
FIG. 5 is a schematic cross-sectional view illustrating the first printhead pressure adjusting mechanism of the thermosensitive printing device as shown in FIG. 2, in which the active pressure element is in an upper position.
Figure 6:
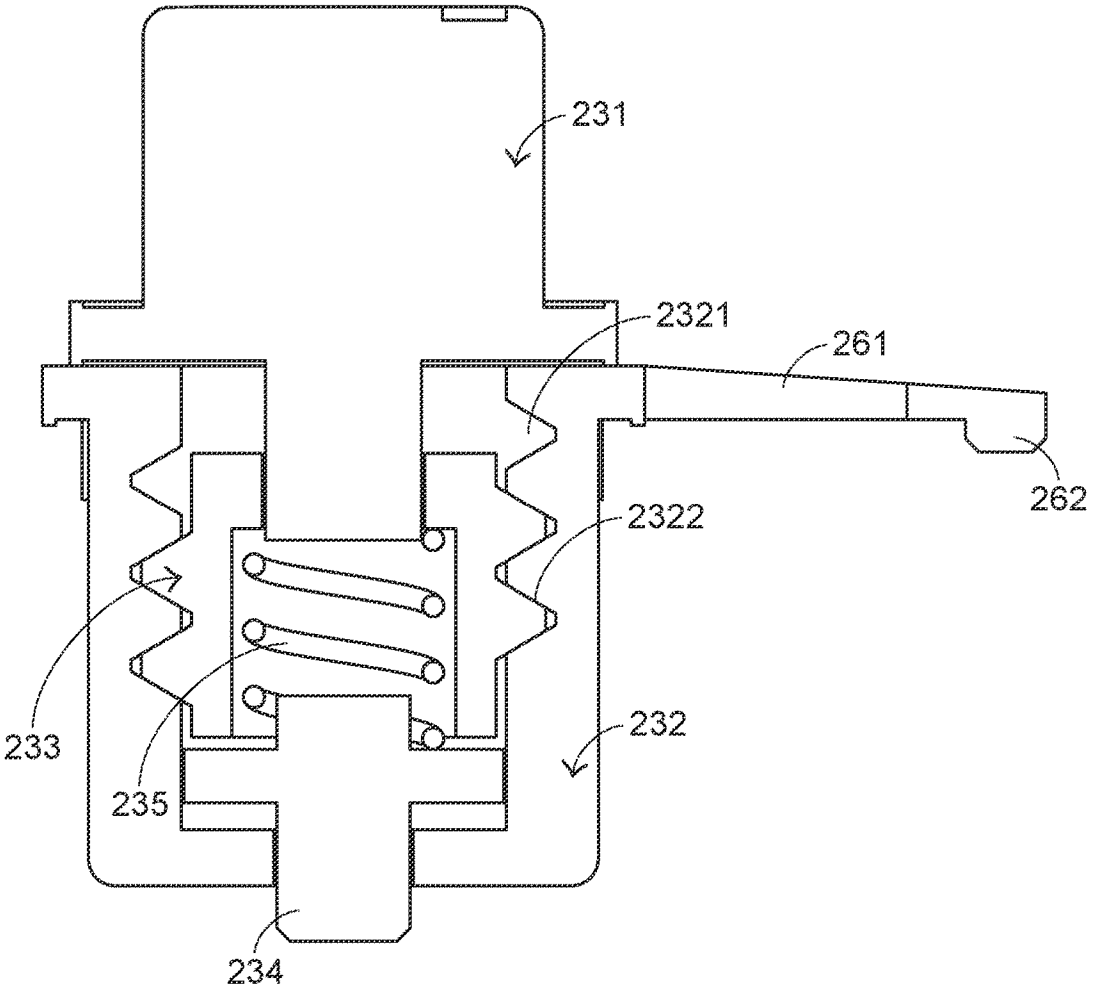
FIG. 6 is a schematic cross-sectional view illustrating the first printhead pressure adjusting mechanism of the thermosensitive printing device as shown in FIG. 2, in which the active pressure element is in a lower position.

Please refer to FIGS. 4, 5 and 6. FIG. 5 is a schematic cross-sectional view illustrating the first printhead pressure adjusting mechanism of the thermosensitive printing device as shown in FIG. 2, in which the active pressure element is in an upper position. FIG. 6 is a schematic cross-sectional view illustrating the first printhead pressure adjusting mechanism of the thermosensitive printing device as shown in FIG. 2, in which the active pressure element is in a lower position. In this embodiment, a polygonal shaft 2311 is protruded from a bottom surface of the adjusting knob 231, and the active pressure element 233 comprises a polygonal recess 2331 corresponding to the polygonal shaft 2311. After the polygonal shaft 2311 is inserted into the polygonal recess 2331, the adjusting knob 231 and the active pressure element 233 are synchronously rotated and the active pressure element 233 is movable upwardly or downwardly relative to the adjusting knob 231. Moreover, a male thread structure 2332 is formed on an external surface of the active pressure element 233, and an internal surface of the outer shell 232 has a female thread structure 2321 corresponding to the male thread structure 2332. While the adjusting knob 231 is rotated and the active pressure element 233 is synchronously rotated, the male thread structure 2332 of the active pressure element 233 is moved along the female thread structure 2321 of the outer shell 232. Consequently, the active pressure element 233 is moved upwardly or downwardly.

In an embodiment, the identification pattern 236 on the top surface of the adjusting knob 231 is a curvy line. The two ends of the curvy line have different sizes. As the adjusting knob 231 is rotated, an orientation of a hollow portion between the two ends of the curvy line is correspondingly changed. According to the orientation of the hollow portion between the two ends of the curvy line, the rotation amount of the identification pattern 236 is recognized by the user. Moreover, according to the rotation amount of the identification pattern 236, the pressure of the first printhead pressure adjusting mechanism 23 applied to the printhead module 22 is recognized.

The constituents and the operations of the second printhead pressure adjusting mechanism 24 are similar to those of the first printhead pressure adjusting mechanism 23, and are not redundantly described herein. Please refer to FIGS. 2, 5 and 6 again. The thermosensitive printing device 2 further comprises a first positioning mechanism 26 and a second positioning mechanism 27. After the first printhead pressure adjusting mechanism 23 is moved to a proper position along the casing groove 251 according to the width of the print medium, the first printhead pressure adjusting mechanism 23 is fixed by the first positioning mechanism 26. Similarly, after the second printhead pressure adjusting mechanism 24 is moved to a proper position along the casing groove 251 according to the width of the print medium, the second printhead pressure adjusting mechanism 24 is fixed by the second positioning mechanism 27.

In an embodiment, the first positioning mechanism 26 comprises an elastic arm 261, a first positioning part 262 and plural second positioning parts 263. A first end of the elastic arm 261 is connected with the outer shell 232 of the first printhead pressure adjusting mechanism 23. The first positioning part 262 is connected with a second end of the elastic arm 261. The plural second positioning parts 263 are discretely formed on a top surface of the casing 25. After the first printhead pressure adjusting mechanism 23 is moved to a proper position along the casing groove 251 according to the width of the print medium, the first positioning part 262 on the first printhead pressure adjusting mechanism 23 and the corresponding second positioning part 263 on the casing 25 are engaged with each other. Consequently, the first printhead pressure adjusting mechanism 23 is fixed by the first positioning mechanism 26. In an embodiment, the first positioning part 262 on the first printhead pressure adjusting mechanism 23 is a positioning bulge, and the second positioning part 263 on the casing 25 is a positioning hole. After the positioning bulge is penetrated through the positioning hole, the positioning bulge and the positioning hole are engaged with each other. The constituents and the operations of the second positioning mechanism 27 are similar to those of the first positioning mechanism 26, and are not redundantly described herein.

Figure 7:
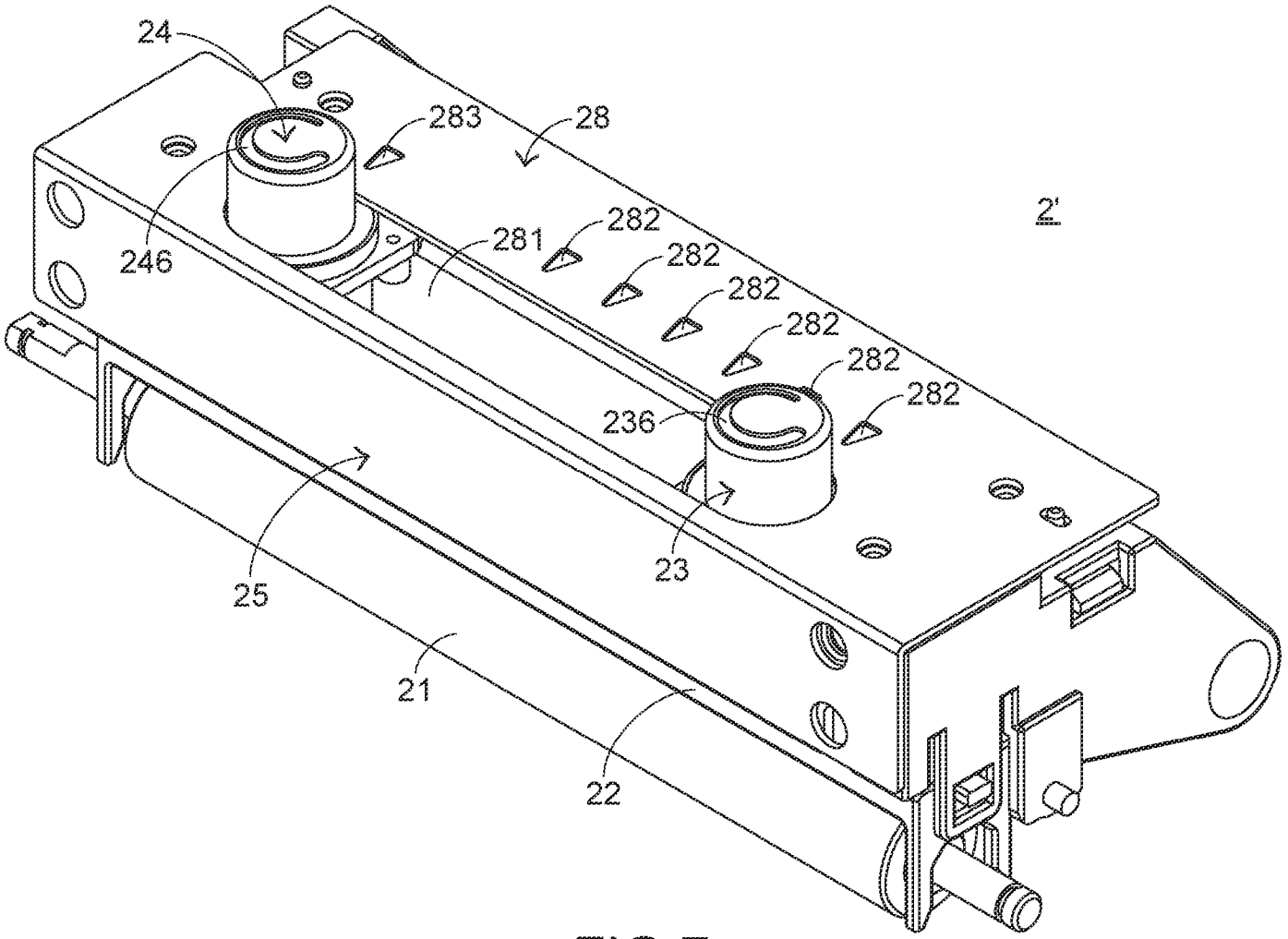
FIG. 7 is a schematic perspective view illustrating a portion of a thermosensitive printing device according to a second embodiment of the present invention.

FIG. 7 is a schematic perspective view illustrating a portion of a thermosensitive printing device according to a second embodiment of the present invention. The components of the thermosensitive printing device 2 that are similar to those of the first embodiment are not redundantly described herein. In comparison with the first embodiment, the thermosensitive printing device 2 of this embodiment further comprises an upper cover 28. The upper cover 28 is located over the casing 25. The upper cover 28 comprises a cover groove 281 corresponding to the casing groove 251. A portion of the first printhead pressure adjusting mechanism 23 and a portion of the second printhead pressure adjusting mechanism 24 are penetrated upwardly through the cover groove 281. Moreover, the first printhead pressure adjusting mechanism 23 and the second printhead pressure adjusting mechanism 24 are movable within the cover groove 281 according to the width of the print medium. The top cover 28 further comprises plural indication marks 282 corresponding to the identification pattern 236, which is formed on the adjusting knob 231 of the first printhead pressure adjusting mechanism 23. According to the relationships between the indication marks 282 and the identification pattern 236, the rotation amount of the identification pattern 236 is recognized. Moreover, according to the rotation amount of the identification pattern 236, the pressure of the first printhead pressure adjusting mechanism 23 applied to the printhead module 22 is recognized.

Figure 8:
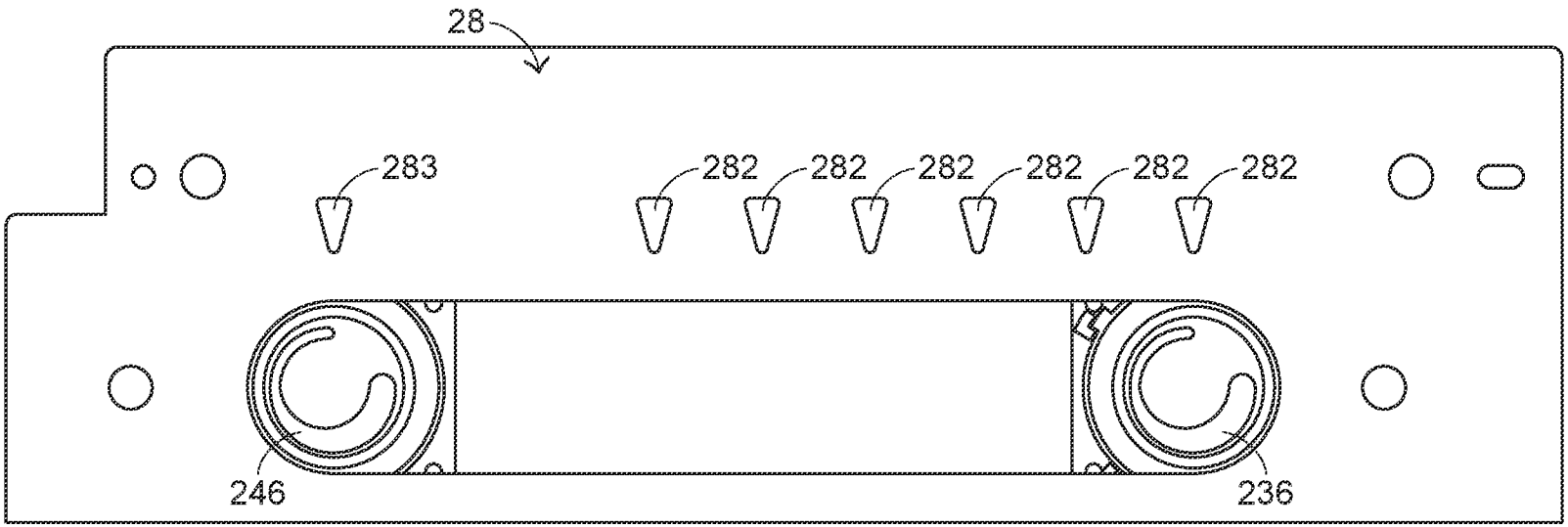
FIG. 8 is a schematic top view illustrating the rotating knob of the first printhead pressure adjusting mechanism of the thermosensitive printing device as shown in FIG. 7, in which the active pressure element is in an upper position.
Figure 9:
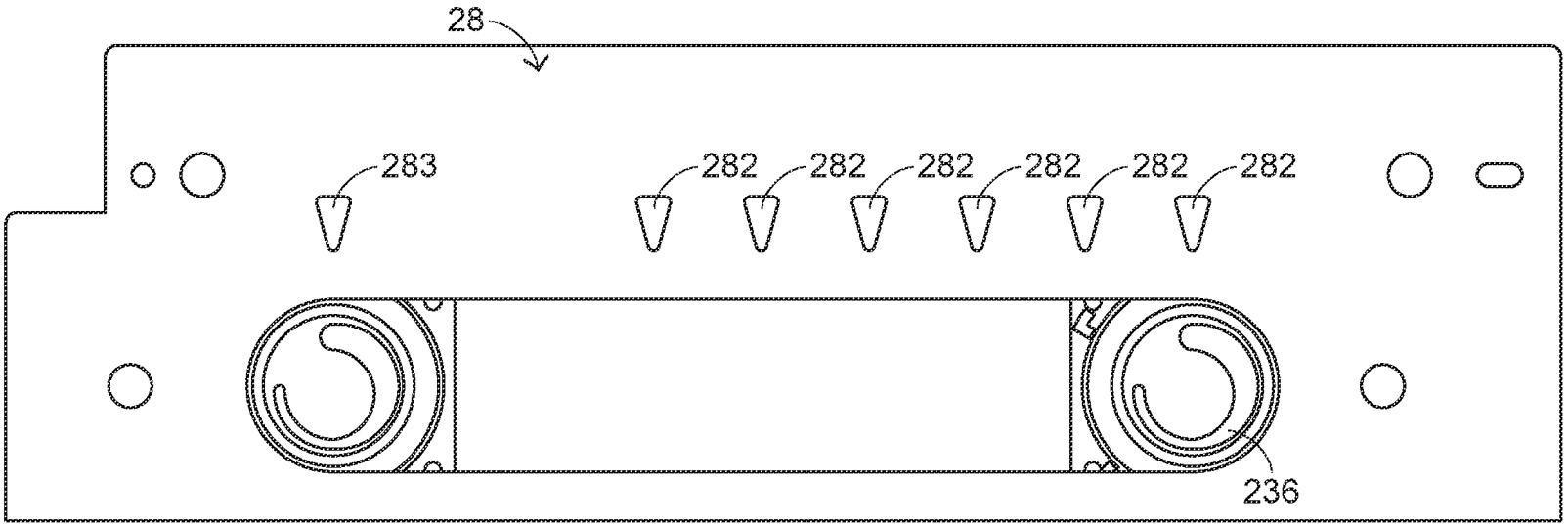
FIG. 9 is a schematic top view illustrating the rotating knob of the first printhead pressure adjusting mechanism of the thermosensitive printing device as shown in FIG. 7, in which the active pressure element is in a lower position.

Please refer to FIGS. 8 and 9. FIG. 8 is a schematic top view illustrating the rotating knob of the first printhead pressure adjusting mechanism of the thermosensitive printing device as shown in FIG. 7, in which the active pressure element is in an upper position. FIG. 9 is a schematic top view illustrating the rotating knob of the first printhead pressure adjusting mechanism of the thermosensitive printing device as shown in FIG. 7, in which the active pressure element is in a lower position. As shown in FIG. 8, one of the plural indication marks 282 points to the smallest end of the curvy line of the identification pattern 236. Meanwhile, the active pressure element 233 is in an upper position (see FIG. 5). As the adjusting knob 231 is rotated and the indication mark 282 points to the largest end of the curvy line of the identification pattern 236 (see FIG. 9), the active pressure element 233 is in a lower position (see FIG. 6). According to the position of the identification pattern 236 pointed by the indication mark 282, the rotation amount of the identification pattern 236 is recognized. Moreover, according to the rotation amount of the identification pattern 236, the pressure of the first printhead pressure adjusting mechanism 23 applied to the printhead module 22 is recognized.

The top cover 28 also comprises at least one indication mark 283 corresponding to the rotating knob of the second printhead pressure adjusting mechanism 24. Similarly, according to the relationship between the at least one indication mark 283 and the identification pattern 246, the rotation amount of the identification pattern 246 is recognized. Moreover, according to the rotation amount of the identification pattern 246, the pressure of the second printhead pressure adjusting mechanism 24 applied to the printhead module 22 is recognized.

It is noted that numerous modifications and alterations may be made while retaining the teachings of the invention. For example, in another embodiment, the identification pattern 236 on the adjusting knob 231 of the first printhead pressure adjusting mechanism 23 contains plural digital number patterns in a circular arrangement. According to the digital number pattern pointed by the indication mark 282, the rotation amount of the adjusting knob 231 is recognized. Moreover, according to the rotation amount of the adjusting knob 231, the pressure of the first printhead pressure adjusting mechanism 23 applied to the printhead module 22 is recognized.

In another embodiment, the adjusting knob 231 of the first printhead pressure adjusting mechanism 23 comprises a polygonal recess, and a polygonal shaft is protruded from a top surface of the active pressure element of the first printhead pressure adjusting mechanism 23. After the polygonal shaft is inserted into the polygonal recess, the adjusting knob 231 and the active pressure element 233 are synchronously rotated and the active pressure element 233 is movable upwardly or downwardly relative to the adjusting knob 231.

In another embodiment, a female thread structure of the first printhead pressure adjusting mechanism 23 is formed on an external surface of the active pressure element 233, and an internal surface of the outer shell 232 has a male thread structure corresponding to the female thread structure. While the adjusting knob 231 is rotated and the active pressure element 233 is synchronously rotated, the male thread structure 2332 of the active pressure element 233 is moved along the female thread structure 2321 of the outer shell 232. Consequently, the active pressure element 233 is moved upwardly or downwardly.

In another embodiment, the first positioning part 262 on the first printhead pressure adjusting mechanism 23 is a positioning hole, and the second positioning part 263 on the casing 25 is a positioning bulge. After the positioning bulge is penetrated through the positioning hole, the positioning bulge and the positioning hole are engaged with each other.

From the above descriptions, the thermosensitive printing device of the present invention has the following advantages. Firstly, the first printhead pressure adjusting mechanism and/or the second printhead pressure adjusting mechanism may be moved to proper positions according to the width of the print medium and fixed at the proper positions. Consequently, the printhead module is not inclined. Since the printhead module and the print medium are contacted with each other in a reliable manner and the applied force is uniform, the possibly of causing the damage of the printhead module is reduced. Secondly, the adjusting knob of the first printhead pressure adjusting mechanism and/or the second printhead pressure adjusting mechanism is exposed to a top side of the casing for facilitating the user to adjust the pressure on the printhead module and move the first printhead pressure adjusting mechanism and/or the second printhead pressure adjusting mechanism. Thirdly, the adjusting knob of the first printhead pressure adjusting mechanism and/or the second printhead pressure adjusting mechanism has an identification pattern for facilitating the user to recognize the rotation amount of the identification pattern on the adjusting knob. If the type of the print medium is changed, the user can rotate the adjusting knob to a proper position quickly according to the rotation amount of the identification pattern. Consequently, the printhead module applies a suitable pressure on the print medium.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A thermosensitive printing device, comprising:

a print roller;

a printhead module located over the print roller, wherein when a print medium is transferred through a region between the printhead module and the print roller, the print medium is printed by the printhead module;

a printhead pressure adjusting mechanism located over the printhead module and contacted with the printhead module, wherein the printhead pressure adjusting mechanism comprises an adjusting knob and an identification pattern, wherein when the adjusting knob is rotated, a pressure of the printhead pressure adjusting mechanism applied to the printhead module is adjusted and the pressure of the printhead pressure adjusting mechanism applied to the printhead module is recognized according to the identification pattern, wherein the identification pattern is formed on a top surface of the adjusting knob and rotated with adjusting knob, wherein the pressure of the printhead adjusting mechanism applied to the printhead module is recognized according to a rotation amount of the identification pattern;

a casing comprising a casing groove, wherein the printhead pressure adjusting mechanism is supported by the casing, at least a portion of the printhead pressure adjusting mechanism is penetrated through the casing groove and movable within the casing groove according to a width of the print medium; and a top cover, wherein the top cover is located over the casing, and comprises a cover groove and an indication mark, wherein at least a portion of the printhead pressure adjusting mechanism is penetrated upwardly through the cover groove and movable within the cover groove, and the rotation amount of the identification pattern is recognized according to a relationship between the indication mark and the identification pattern.

2. The thermosensitive printing device according to claim 1, wherein the printhead pressure adjusting mechanism further comprises an active pressure element, a passive pressure element and an elastic element, wherein the elastic element is arranged between the active pressure element and the passive pressure element, a first end of the passive pressure element is contacted with the elastic element, and a second end of the passive pressure element is contacted with the printhead module, wherein while the adjusting knob is rotated, the active pressure element is synchronously rotated and moved upwardly or downwardly, so that a deformation amount of the elastic element is changed, wherein as the deformation amount of the elastic element is changed, a pressure of the second end of the passive pressure element applied to the printhead module is correspondingly changed.

3. The thermosensitive printing device according to claim 2, wherein one of the adjusting knob and the active pressure element has a polygonal shaft, and the other of the adjusting knob and the active pressure element has a polygonal recess, wherein the polygonal shaft is inserted into the polygonal recess, so that the adjusting knob and the active pressure element are synchronously rotated.

4. The thermosensitive printing device according to claim 2, wherein the printhead pressure adjusting mechanism further comprises an outer shell, wherein the outer shell is located under the adjusting knob, and the active pressure element, the passive pressure element and the elastic element are accommodated within the outer shell.

5. The thermosensitive printing device according to claim 4, wherein if an internal wall of the outer shell has a male thread structure, an external wall of the active pressure element has a female thread structure corresponding to the male thread structure, wherein if the external wall of the active pressure element has a male thread structure, the internal wall of the outer shell has a female thread structure corresponding to the male thread structure, wherein while the adjusting knob is rotated and the active pressure element is synchronously rotated, the external thread structure is moved along the internal thread structure, the active pressure element is moved upwardly or downwardly.

6. The thermosensitive printing device according to claim 1, further comprising a positioning mechanism, wherein after the printhead pressure adjusting mechanism is moved to a proper position according to the width of the print medium, the printhead pressure adjusting mechanism is fixed by the positioning mechanism.

7. The thermosensitive printing device according to claim 6, wherein the first positioning mechanism comprises an elastic arm, a first positioning part and plural second positioning parts, wherein a first end of the elastic arm is connected with the printhead pressure adjusting mechanism, the first positioning part is connected with a second end of the elastic arm, the plural second positioning parts are discretely formed on a top surface of the casing, wherein after the printhead pressure adjusting mechanism is moved to the proper position according to the width of the print medium, the first positioning part is engaged with one of the plural second positioning parts, so that the printhead pressure adjusting mechanism is fixed by the positioning mechanism.

8. The thermosensitive printing device according to claim 7, wherein if the first positioning part is a positioning bulge, each of the plural second positioning parts is a positioning hole, wherein if the first positioning part is a positioning hole, each of the plural second positioning parts is a positioning bulge.

9. A thermosensitive printing device, comprising:

a print roller;

a printhead module located over the print roller, wherein when a print medium is transferred through a region between the printhead module and the print roller, the print medium is printed by the printhead module;

a printhead pressure adjusting mechanism located over the printhead module and contacted with the printhead module, wherein the printhead pressure adjusting mechanism comprises an adjusting knob and an identification pattern, wherein when the adjusting knob is rotated, a pressure of the printhead pressure adjusting mechanism applied to the printhead module is adjusted and the pressure of the printhead pressure adjusting mechanism applied to the printhead module is recognized according to the identification pattern;

a casing comprising a casing groove, wherein the printhead pressure adjusting mechanism is supported by the casing, at least a portion of the printhead pressure adjusting mechanism is penetrated through the casing groove and movable within the casing groove according to a width of the print medium; and a positioning mechanism, wherein after the printhead pressure adjusting mechanism is moved to a proper position according to the width of the print medium, the printhead pressure adjusting mechanism is fixed by the positioning mechanism, wherein the first positioning mechanism comprises an elastic arm, a first positioning part and plural second positioning parts, wherein a first end of the elastic arm is connected with the printhead pressure adjusting mechanism, the first positioning part is connected with a second end of the elastic arm, the plural second positioning parts are discretely formed on a top surface of the casing, wherein after the printhead pressure adjusting mechanism is moved to the proper position according to the width of the print medium, the first positioning part is engaged with one of the plural second positioning parts, so that the printhead pressure adjusting mechanism is fixed by the positioning mechanism.

10. The thermosensitive printing device according to claim 9, wherein if the first positioning part is a positioning bulge, each of the plural second positioning parts is a positioning hole, wherein if the first positioning part is a positioning hole, each of the plural second positioning parts is a positioning bulge.

* * * * *